US010055916B1

(12) United States Patent
Helligrath

(10) Patent No.: US 10,055,916 B1
(45) Date of Patent: Aug. 21, 2018

(54) REMOTE VEHICLE ACCESS SYSTEM

(71) Applicant: Honda Motor Co., Ltd., Tokyo (JP)

(72) Inventor: Eric E. Helligrath, Beavercreek, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/420,732

(22) Filed: Jan. 31, 2017

(51) Int. Cl.

| | |
|---|---|
| ***G07C 9/00*** | (2006.01) |
| ***E05B 77/54*** | (2014.01) |
| ***E05B 81/04*** | (2014.01) |
| ***E05B 81/76*** | (2014.01) |
| ***E05B 81/78*** | (2014.01) |
| ***E05B 19/00*** | (2006.01) |

(52) U.S. Cl.
CPC ..... *G07C 9/00111* (2013.01); *E05B 19/0082* (2013.01); *E05B 77/54* (2013.01); *E05B 81/04* (2013.01); *E05B 81/76* (2013.01); *E05B 81/78* (2013.01); *G07C 9/00182* (2013.01); *G07C 9/00309* (2013.01); *G07C 2009/00317* (2013.01)

(58) Field of Classification Search
CPC ..... G07C 9/00309; G07C 9/00111
USPC ..... 340/5.51
See application file for complete search history.

(56) References Cited

U.S. PATENT DOCUMENTS

| | | | | |
|---|---|---|---|---|
| 4,571,884 | A | 2/1986 | Hetmann et al. | |
| 6,075,294 | A | 6/2000 | Van Den Boom et al. | |
| 6,246,195 | B1 * | 6/2001 | Kloesters | E05F 15/70 318/266 |
| 7,392,619 | B2 | 7/2008 | Pantke et al. | |
| 7,402,917 | B2 * | 7/2008 | Gehin | E05B 81/78 307/9.1 |
| 7,937,893 | B2 | 5/2011 | Pribisic et al. | |
| 8,091,280 | B2 | 1/2012 | Hanzel et al. | |
| 8,346,467 | B2 | 1/2013 | Vaysse et al. | |
| 8,708,396 | B2 | 4/2014 | Konchan | |
| 8,786,401 | B2 | 7/2014 | Sobecki et al. | |
| 2011/0148575 | A1 | 6/2011 | Sobecki et al. | |
| 2012/0136532 | A1 | 5/2012 | Konchan | |

FOREIGN PATENT DOCUMENTS

| | | | |
|---|---|---|---|
| DE | 10338767 | A1 | 3/2005 |
| WO | 2012175647 | A2 | 12/2012 |

* cited by examiner

*Primary Examiner* — Vernal Brown

(74) *Attorney, Agent, or Firm* — Kenealy Vaidya LLP

(57) ABSTRACT

A remote access system is configured for use with a fob configured to lock and unlock a vehicle, the vehicle including a door having a handle, a window, and a window actuator. The system includes a position sensor configured to detect proximity between and relative position of the fob and the door of the vehicle. The remote access system also includes a contact sensor configured to detect contact with the handle. The system further includes a processor configured to communicate with the position sensor and the contact sensor to lower the window a predetermined amount that facilitates opening of the door via the window actuator upon the processor determining: 1) the handle has been contacted, and 2) the fob is disposed at a specified position relative to the door of the vehicle.

19 Claims, 4 Drawing Sheets

REMOTE VEHICLE ACCESS SYSTEM

BACKGROUND

Vehicle access systems, particularly systems that partially lower and raise door windows in accordance with opening and closing the corresponding doors, promote enhanced ingress and egress for operators and passengers by separating seals formed between windows and adjacent weather strips. Actuation of conventional vehicle access systems often results in excessive wear of door seal components, such as the window and weather strip, from lowering of the windows after the door is already unlatched and partially opened. This excessive wear can lead to improper and failing seals between the interior and exterior of the vehicle at the windows and weather strips, permitting potentially damaging substances to enter the vehicle at the seals.

A need was identified for an effective remote vehicle access system capable of automatically indexing a door window downward in anticipation of opening the door by an operator such that potential wear on the window and adjacent weather strip is impeded.

SUMMARY

According to one aspect, a remote access system is configured for use with a fob configured to lock and unlock a vehicle, the vehicle including a door having a handle, a window, and a window actuator. The system includes a position sensor configured to detect proximity between and relative position of the fob and the door of the vehicle. The remote access system also includes a contact sensor configured to detect contact with the handle. The system further includes a processor configured to communicate with the position sensor and the contact sensor to lower the window a predetermined amount that facilitates opening of the door via the window actuator upon the processor determining: 1) the handle has been contacted, and 2) the fob is disposed at a specified position relative to the door of the vehicle.

According to another aspect, vehicle includes at least one closure with a handle that includes at least one locking device configured to selectively lock and unlock the closure, a window connected to a window actuator and configured to span a portion of the closure such that the window may be raised and lowered across the portion of the closure, and a remote access system for use with a fob that is configured to lock and unlock the vehicle. The system includes a position sensor configured to detect proximity between and relative position of the fob and the closure of the vehicle. The system also includes a contact sensor configured to detect contact with the handle. The system further includes a processor configured to communicate with the position sensor and the contact sensor to lower the window a predetermined amount that facilitates opening of the door via the window actuator upon the processor determining that the fob is disposed at a specified position relative to the closure of the vehicle and that the handle has been contacted.

According to yet another aspect, a method of operating a remote access system for a vehicle includes detecting, with a position sensor, a key fob at a specified position relative to a door of the vehicle, communicating, via a processor, with the key fob, and authenticating, via the processor, a transmission of the key fob. The method also includes detecting, with a contact sensor, a contact with a door handle, unlocking the vehicle door if the key fob is authenticated and contact with the door handle is detected, and actuating the window to lower a predetermined amount if the vehicle door is unlocked.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

I. Overall System

Figure 1:
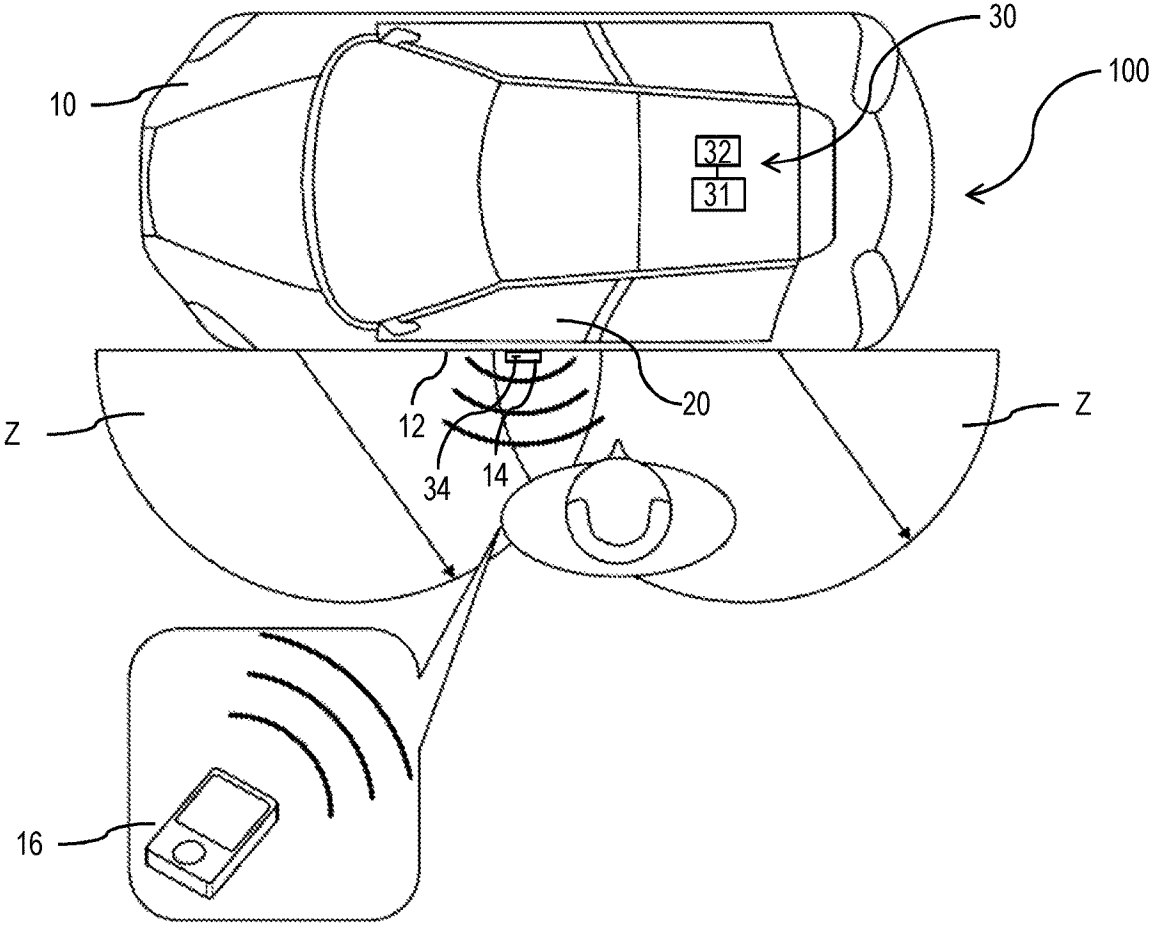
FIG. 1 is a schematic representation of an exemplary remote vehicle access system including a vehicle and a transmitter in accordance with the disclosed subject matter.

FIG. 1 is a schematic representation of an exemplary remote vehicle access system 100 in accordance with the disclosed subject matter. The exemplary remote vehicle access system 100 is configured for use with a vehicle 10 and a fob 16, the fob 16 capable of remotely transmitting and receiving signals to and from the vehicle 10.

The fob 16 in the present embodiment may be configured as a vehicle key fob, and may perform operations such as locking and unlocking the vehicle, as well releasing and/or closing a trunk, raising and/or lowering windows, opening and/or closing a sunroof, starting/stopping an engine/motor, and other vehicular operations capable of being initiated remotely. In some embodiments, the fob 16 may alternatively be configured as a smartphone, portable computer such as a laptop, tablet, etc.

The vehicle 10 can be configured as a passenger vehicle, a racecar, a commercial vehicle (i.e., a truck), or any other type of vehicle. An interior of the vehicle 10 defines a passenger area (i.e., a cabin) for vehicle operators and/or passengers, particularly during operation of the vehicle. The vehicle 10 shown in FIG. 1 is primarily for use on paved roadways, and can be referred to as a passenger vehicle. The vehicle 10 may also be for use on unpaved roadways consisting of gravel, dirt, sand, etc.

The vehicle 10 includes closures such as doors through which operators and/or passengers may enter and exit the cabin, the doors configured along sides of the exemplary vehicle 10. However, the doors may additionally be oriented along a front or back of the vehicle 10. The doors 12 can be manually operable, power-assisted or automatic. The doors 12 can support respective windows 20, each of which being slidable with respect to the door 12 between an opened and a closed position via an opening mechanism. As shown in more detail and described below in reference to FIG. 2, the door 12 can be configured without a window frame such that the window 20 is a sashless-type window configured to abut an adjacent roof portion in the closed position. When in the closed position, each of the windows 20 is configured to form a seal against adjacent portions of the roof of the vehicle 10 to prevent unwanted substances from entering the cabin of the vehicle 10 and reduce wind noise during travel.

The vehicle 10 is further configured to include a sensor system 30 having a processor 31 coupled with a position sensor 32 and a contact sensor 34. The sensor system 30 may transmit and receive signals to and from the fob 16 to perform various vehicle operations.

A. Position Sensor

Figure 2:
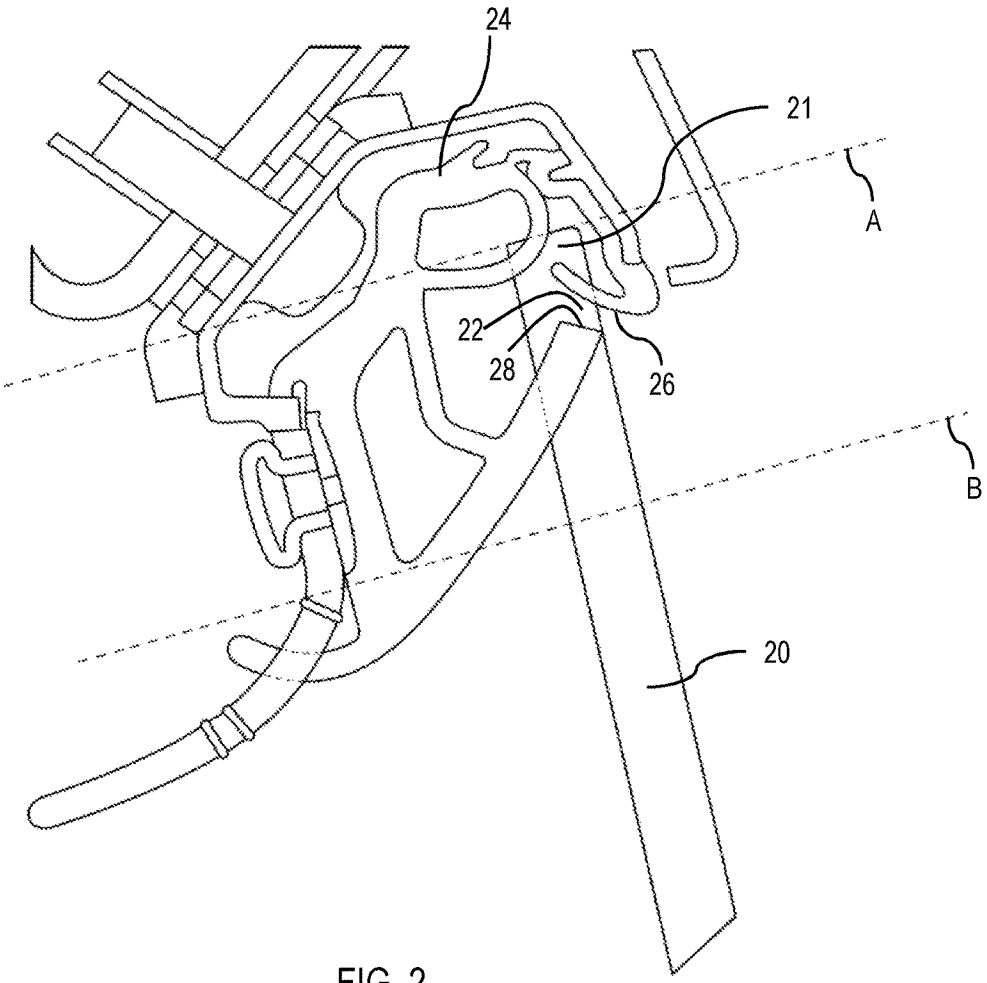
FIG. 2 is a cross-section view of an exemplary door window and weather strip in accordance with the disclosed subject matter.
Figure 3:
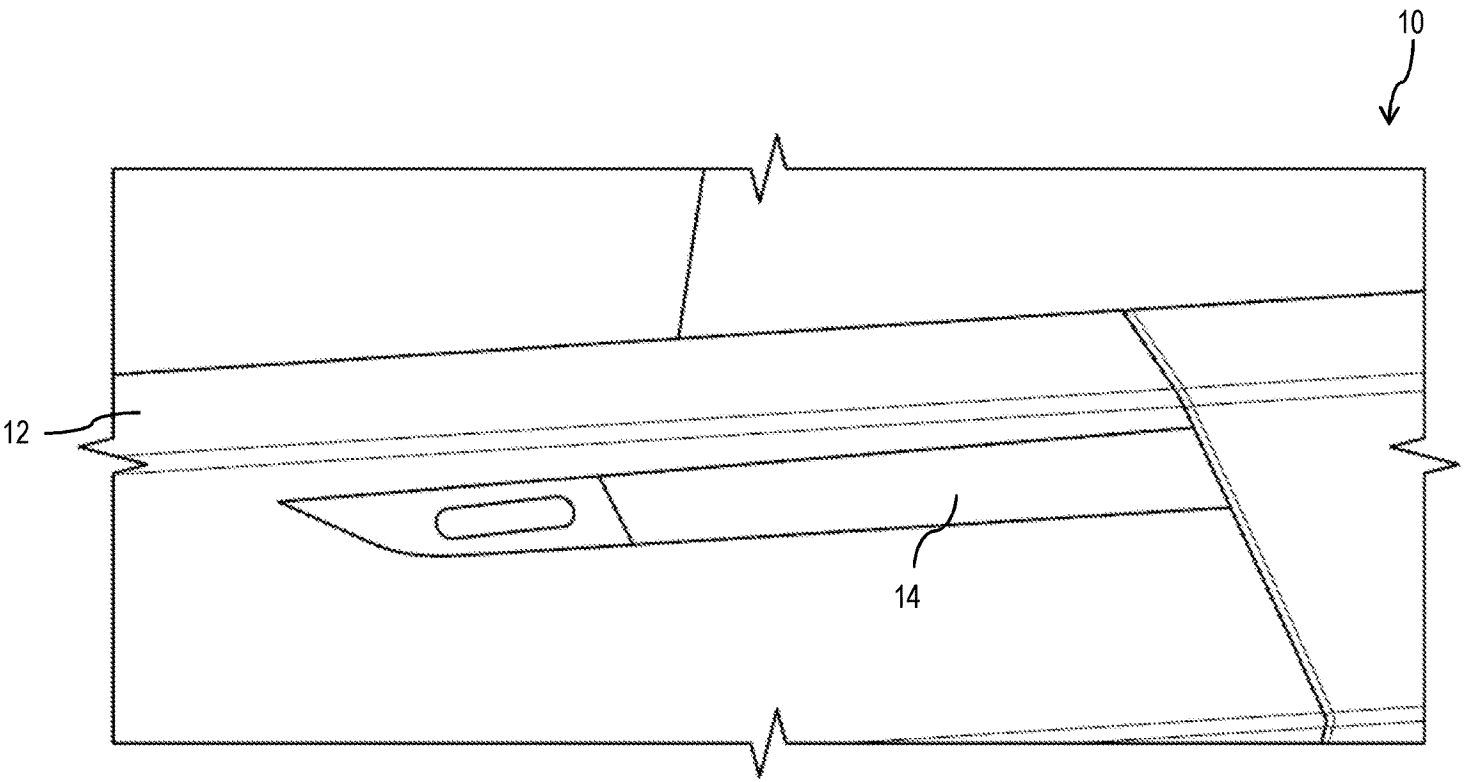
FIG. 3 is a perspective view of an exemplary door handle for a vehicle in accordance with the disclosed subject matter, the door handle shown in a retracted position.
Figure 4:
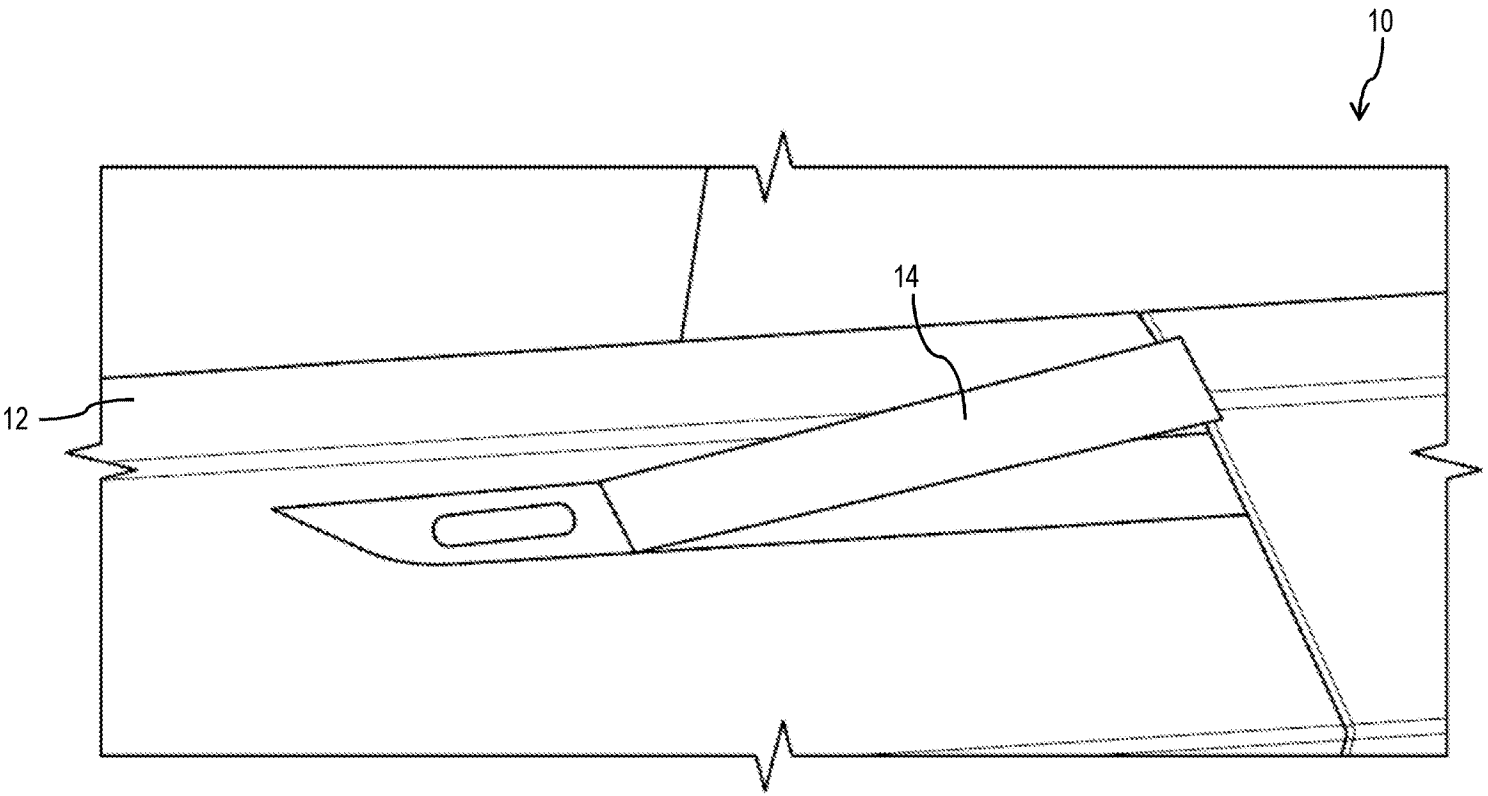
FIG. 4 is a perspective view of the door handle of FIG. 3 in a deployed position.

In the present embodiment, the position sensor 32 can be configured to determine overall proximity between the vehicle 10 and the fob 16, as well as relative position of the fob 16 with respect to the vehicle 10. Specifically, the position sensor 32 can detect whether the fob 16 is within a specified range of the vehicle 10, and additionally whether the fob 16 is within a specified communication zone Z relative to the vehicle 10. Some embodiments of the position sensor 32 are configured to detect whether the fob 16 is within a specified range of a particular part of the vehicle 10, such as a handle 14 of the door 12. Furthermore, these embodiments of the position sensor 32 are configured to detect whether the fob 16 is within a specified communication zone Z relative to the handle 14. The position sensor therefore detects whether or not the fob 16 is at a specified position relative to the vehicle 10, or in some cases a specific component of the vehicle 10 such as the handle 14 of the door 12. As shown in FIGS. 2-4 and described below, position sensor 32 can be configured to communicate with the processor 31 to perform vehicle operations such as lowering and/or raising the windows 20, and in some embodiments, deploying and retracting the handle 14 of the door 12.

A processor may include any combination of several processors, printed circuit boards, and control units, as described in the present disclosure. The processor(s) may be associated with an intelligent/remote entry system, also known as a SMART entry system. SMART entry system includes a body control module (BCM) with a SMART electronic control unit (ECU) and MICU, MICU controls many body functions including power windows (with a power window ECU), lights, locks, and the like.

As described above, the position sensor 32 can detect whether the fob 16 is at a specified position relative to the vehicle 10 or a part of the vehicle 10 such as the handle 14 to determine whether the fob 16 is within a specified range of the vehicle 10, and whether the fob 16 is within a specified communication zone Z relative to the vehicle 10. While the specified range from the vehicle 10 may be a directionless distance from the vehicle 10, the specified communication zone(s) Z can be positional areas around various parts of the vehicle 10, such as at the entry/exit points defined at the doors 12. As shown in FIG. 1, the exemplary communication zones are approximately semicircular and disposed along the left side of the vehicle 10 corresponding to front and rear doors. However, communication zones may be disposed along any portions of the vehicle 10, and any number of communication zones may be appropriate, including one, two, three, four, etc. The communication zones Z may also be otherwise shaped so as to accommodate varied access areas for operators/passengers.

In the present embodiment, the communication zones Z are semicircular areas extending from the left side of the vehicle 10 with a radius of two (2) meters. However, embodiments may include semicircular communication zones each having a radius of greater than or less than 2 meters, such as 0.5, 1, 2.5, 3, etc. Furthermore, semicircular communication zones may have varied radii resulting in varied sizes such that, for example, the communication zone adjacent the driver's door is larger than that adjacent the passenger door. Additionally, the communication zones Z can be configured to overlap one another as shown in the embodiment displayed in FIG. 1.

B. Contact Sensor

In the present embodiment, the contact sensor 34 can be configured to determine when a structure of the vehicle 10 has been contacted, such as by an operator or a passenger. For example, the handle 14 may include the contact sensor 34 that can detect an operator or passenger touching the handle 14. Specifically, the contact sensor 34 can be a capacitive sensor configured to sense a hand of an operator or passenger grasping the handle 14 prior to pulling the handle 14 to open the door 12.

In some embodiments, the contact sensor 34 may be configured to detect contact when an operator or passenger has the fob 16 on their person, such as being held in a hand or disposed in a pocket, for example. In other embodiments, the contact sensor 34 may be configured to detect contact when an operator or passenger does not have the fob 16 on their person, and the fob 16 is instead disposed within the cabin of the vehicle 10. Furthermore, some embodiments of the contact sensor 34 may be configured to detect contact when the fob 16 is neither on the operator or passenger's person nor disposed within the cabin of the vehicle 10.

Other embodiments of the contact sensor 34 may work in tandem with the position sensor 32 described above. Namely, the contact sensor 34 may be configured to detect contact if the position sensor 32 detects that the fob 16 is within the specified range of the vehicle 10, and additionally whether the fob 16 is within the specified communication zone Z relative to the vehicle 10.

In some configurations, capacitive sensors can be disposed on each of the vehicle doors, whereas other embodiments may feature capacitive sensors on solely a driver's door or front doors. Additionally, multiple capacitive sensors may be included as part of each of the contact sensors 34. Other sensor types can alternatively be implemented, and contact sensors can be disposed on the inside and/or outside of door handles, or on other parts of vehicle door panels, and even on other areas of the vehicle besides the doors.

II. Window Assembly

As shown in detail in FIG. 2, the doors 12 of the present embodiment can support respective windows 20, each of which being slidable with respect to the door 12 between an opened and a closed window position A via an opening mechanism, such as a window actuator or regulator. The door 12 can be configured without a window frame such that the window 20 is a sashless-type window. The sashless-type window 20 is thus configured to abut an adjacent roof portion when in the closed window position A. In the closed position A, a top window edge 21 of the window 20 is configured to form a seal against the adjacent portion of the roof. A weather strip 24 may be disposed along the adjacent portion of the roof to facilitate the seal with the respective window 20.

In the present embodiment, when the window 20 is in the closed position A with the door 12 closed, the window 20 extends into a channel 22 defined by the weather strip 24 along the roof portion. The channel 22 can be a lateral groove in the weather strip 24 that serves as a gasket to form a seal between the interior and exterior of the vehicle 10 along the weather strip 24. Specifically, the channel 22 can be defined as a longitudinal gap between an outer strip 26 and an inner strip 28 that extends along the adjacent roof portion. As shown in FIG. 2, the outer and inner strips 26,28 can extend into the channel 22 such that the top window edge 21 contacts relatively planar surfaces thereof. The outer and inner strips 26,28 are configured to deform when contacted by the top window edge 21, bending further inward toward the channel 22 as the window 20 slides upward toward the roof portion. When the window is in the closed position A, the outer and inner strips 26,28 maintain the above described deformation and exhibit reflexive pressing forces against inner and outer sides of the window, respectively. These reflexive pressing forces from the inner and outer strips 26,28 form seals inside and outside the cabin of the vehicle 10 at the top window edge 21. As described above, the seals between the weather strip 24 and the window 20 serve to prevent substances outside of the vehicle 10 from entering to the cabin. The seals can also serve to stabilize the windows 24 during travel, especially during high speed travel, improving structural integrity along door openings and impeding wind noise at the windows 24.

The weather strip 24 may be formed of an elastic material, such as rubber, to incorporate reflexive characteristics described above. Upon lowering the window from the closed position A, the inner and outer strips 26,28 of the weather strip 24 are configured to reflexively bend back to an original orientation prior to being contacted by the top window edge 21. When no longer contacted by the top window edge 21, substances and airflow may pass between the interior and exterior of the vehicle in the opening formed between the roof portion and the lowered window 24. This passage of airflow, for example, may be beneficial to regulate pressure differences outside of the vehicle 10 and within the cabin.

In the present embodiment, the window 24 is configured as a motorized window pane to automatically slide away from the weather strip 24 into a partially opened window position B to permit opening of the door 12. Because the outer side of the window 24 is no longer constrained by the outer strip 26, the door 12 may now be opened outward to facilitate ingress and egress from the vehicle 10. Before being lowered to the partially opened position B, the outer strip 26 constrains outward movement of the window 24 to stabilize the window 24 during operation of the vehicle 10, as discussed above.

The partially opened position B is defined as a position of the window 24 in which the top window edge 21 has been removed from the channel 22 and is spaced from the outer and inner strips 26,28 of the weather strip 24 such that the outer and inner strips 26,28 are reflexively returned to their original orientation, as described above. This partially opened position B additionally allows a passageway to form for airflow to pass from the cabin to outside of the vehicle 10, and vice versa.

When the door 12 is subsequently closed, the window 20 is configured to automatically slide from the partially opened position B to the closed position A such that the window 20 is returned into engagement with the weather strip 24. The window 24 is thereby brought back into engagement by the outer and inner strips 26,28, which provide support for the top window edge 21 to impede the window 20 from bending or moving inward and outward during operation of the vehicle 10.

In the present embodiment, the processor 31 can communicate with the window actuator to move the window 20 between the closed position A and the partially opened position B. Particularly, the processor 31 can be configured to communicate with the position sensor 32 and the contact sensor 34 to lower the window a predetermined amount corresponding to the distance between the top window edge 21 in the closed position A and the partially opened position B. Lowering the window 20 by the predetermined amount facilitates opening of the door 12 as described above, and the window actuator can lower the window 24 the predetermined amount upon the processor determining that the handle 14 has been contacted, and that the fob 16 is disposed at a specified position relative to the door 12 of the vehicle 14. Thus, the remote vehicle access system 100 is configured to lower the window 20 from the closed position A to the partially opened position B upon the processor 31 determining that the handle 14 has been contacted and the fob 16 is disposed at a specified position within the communication zone Z.

In some embodiments, the system 100 may be configured to lower the window 20 from the closed position A to the partially opened position B upon the processor 31 determining that the handle 14 has been contacted and the door 12 has been unlocked by the fob 16. Still other embodiments may additionally require that the processor 31 determines that the fob 16 is disposed at a specified position within the communication zone Z, as well as the door 12 of the vehicle 10 being unlocked and the handle 14 being touched in order for the window 20 to automatically move from the closed position A to the partially opened position B.

III. Door Handle

FIGS. 3 and 4 illustrate an exemplary door handle in accordance with the present disclosure. The handle 14 shown in FIGS. 3 and 4 is configured to be retractable so as to be pivotable between a retracted position and a deployed position. When in the retracted position, as shown in FIG. 3, the door handle 14 is stowed to be generally flush with adjacent portions of the door 12. When in the deployed position, as shown in FIG. 4, the door handle 14 extends away from the door 12 such that it serves as a protrusion that can be grasped by a user such as an operator or passenger and pivoted into an actuated position to open the door 12. The handle 14, once in the deployed position, may thus be actuable into a pulled position similar to non-retractable door handles to open the door 12. In the present embodiment, the handle 14 is pivotable about a forward portion thereof. However, other embodiments may include a handle pivotable about a rearward portion thereof, or a handle that retracts and extends linearly from the door 12 rather than pivots.

Other embodiments may include a retractable handle that moves between retracted and deployed positions laterally, rather than pivoting between positions. Specifically, the laterally retractable handle can slide from a position flush with the door panel to a protruding position so that it may be grabbed by an operator. The following description of sensor-based movement of the door handle 14 is intended to cover multiple configurations of handles including laterally retracting handles.

In still other embodiments, the handle 14 may be a non-retractable door handle. In such an embodiment, the handle can pivot or slide within the door 12 between a first (released) position and a second (actuated) position. When in the released position, the non-retractable handle 14 can protrude from the door 12 or remain flush with adjacent portions of the door 12 with a concave space indented in the door behind the handle 14 to provide space for a user or operator to reach under and grasp the handle 14.

The door handle 14 of the present embodiment can be automatically pivotable between the retracted position and the deployed position in response to the proximity and relative position of the remote key fob 16 relative to the vehicle 10, as detected by the position sensor 32 and illustrated in FIG. 1. The remote vehicle access system 100 of the vehicle 10 can be configured as a remote keyless entry (RKE) system configured to automatically detect the remote key fob 16 within a communication zone Z. When the remote key fob 16 is outside of the communication zone Z, the door handle 14 is disposed in the retracted position. When the remote key fob 16 is moved into the communication zone Z, the door handle 14 automatically pivots to the deployed position.

The handle 14 may be configured to remain in the deployed position while the fob 16 is within the communication zone Z, or may alternatively be configured to pivot back to the retracted position after a predetermined amount of time passes. Similarly, the handle 14 may be configured to return to the retracted position when the fob 16 is removed from the communication zone Z. The handle 14 may furthermore be configured to retract upon locking the door 12 via the fob 16. Other operations that may cause the handle 14 to retract include subsequent closing of the door 12 once opened, starting of the engine/motor, initiating an alarm sequence of the vehicle 10, or any other operation signaling that operation of the handle 14 is not imminent.

As described above, the door handle 14 comprises a touch-sensitive handle including the contact sensor 34, which may be configured as a capacitive sensor. The retractable handle 14 can thusly be configured with the contact sensor 34 to communicate with the processor 31 such that the processor 31 instructs a subsytem control unit, such as a MICU (multiplex integrated control unit), or alternatively a lock actuator directly, to selectively unlock the doors 12 and the subsystem, or alternatively, the window actuator directly, to lower the window 24 the predetermined amount upon the processor 31 determining that the retractable handle 14 has been contacted, and, as described above, that the fob 16 is disposed at a specified position relative to the door 12 of the vehicle 14 and that a transmission, such as an access code, of the fob 16 is authentic.

In the embodiment of the remote vehicle access system 100 having the retractable handle 14, when the handle 14 is in the deployed position, the processor 31 is configured to automatically instruct the window actuator to move the window 20 to the partially opened position B when contact with the handle 14 is detected by the contact sensor 34, as illustrated in FIG. 2. Thus, the handle 14 can first be pivoted to the deployed position before the window 20 can be lowered from the closed position A to the partially opened position B via the contact sensor 34 determining contact with the handle 14. In this embodiment, the handle 14 may first pivot to the deployed position when the fob 16 is brought near the vehicle 10, or specifically into the communication zone Z adjacent the door 12 or handle 14, and authenticated. The window 20 may then lower the predetermined amount to create clearance between the weather strip 24 and the top window edge 21 upon a user such as an operator or a passenger touching the deployed handle 14. After the window 20 moves to partially open position B, if the processor 31 determines the key fob 16 signal becomes deactivated, such as removal from the communication zone Z, and the door 12 has no change in state, then the processor 31 can instruct the window actuator to move the window 20 to the closed position A. Alternatively, if the fob 16 signal remains active within the communication zone Z for greater than a predetermined time period, then the processor 31 can instruct the window actuator to move the window 20 to the closed position A. Automatically returning the window 20 to the closed position A under certain circumstances may serve to reduce rain and other foreign matter entry into the vehicle interior depending on the shape of the sealing structure and its interface to the window 20.

The system 100 enhances vehicle access by remotely anticipating entry into the vehicle 10 by contact from a user such as an operator or passenger without the user having to manually perform functions via the fob 16. Furthermore, the proximity and relative positioning of the fob 16 promote convenient and safe access of an authorized or verified user with the ability to operate the vehicle 10. Other embodiments may feature various vehicle access processes such that an order of the handle deployment and window lowering is varied.

IV. Alternative Embodiments

While certain embodiments of the invention are described above, and FIGS. 1-4 disclose the best mode for practicing the various inventive aspects, it should be understood that the invention can be embodied and configured in many different ways without departing from the spirit and scope of the invention.

For example, embodiments are disclosed above in the context of the remote vehicle access system 100 configured for use with the fob 16 and the vehicle 10 as shown in FIG. 1. However, embodiments are intended to include or otherwise cover remote vehicle access systems configured for use with any type of transmitter and any type of vehicle.

As disclosed above, embodiments are intended to be used with any type of vehicle. The power source of the vehicle can be an internal combustion engine, an electric motor, or a hybrid of an internal combustion engine and an electric motor. The power source configured as an internal combustion engine or a hybrid power source can have the engine output axis oriented in the longitudinal direction or in the traverse direction of the vehicle. The engine can be mounted forward of the front axles, rearward of the rear axles, or intermediate the front and rear axles.

The vehicle can include any type of transmission, including an automatic transmission, a manual transmission, or a semi-automatic transmission. The transmission can include an input shaft, an output shaft, and a speed ratio assembly.

Embodiments are also intended to include or otherwise cover methods of using and methods of manufacturing any or all of the elements disclosed above. The methods of manufacturing include or otherwise cover processors and computer programs implemented by processors used to design various elements of the remote vehicle access system disclosed above.

While the subject matter has been described in detail with reference to exemplary embodiments thereof, it will be apparent to one skilled in the art that various changes can be made, and equivalents employed, without departing from the scope of the invention. All related art references discussed in the above Background section are hereby incorporated by reference in their entirety.

What is claimed is:

1. A remote access system for use with a fob configured to lock and unlock a vehicle, the vehicle including a door having a handle, a window, and a window actuator, the remote access system comprising:

a position sensor configured to detect proximity between and relative position of the fob and the door of the vehicle;

a contact sensor configured to detect contact with the handle; and a processor configured to, to extend the handle away from the door to a deployed position upon the processor determining that the fob is disposed at a specified position relative to the door closure of the vehicle, and communicate with the position sensor and the contact sensor to lower the window a predetermined amount that facilitates opening of the door via the window actuator upon the processor determining the handle has been contacted when the handle is in the deployed position.

2. The remote access system according to claim 1, wherein the processor is configured to lower the window upon the processor determining that the fob is within a specified range of the vehicle.

3. The remote access system according to claim 1, wherein the processor is configured to lower the window upon the processor determining that the contact sensor detects contact with the handle, the fob is authenticated, and the door has been unlocked.

4. The remote access system according to claim 1, wherein the processor is configured to raise the window the predetermined amount via the window actuator following the lowering of the window upon the processor determining that the fob is disposed at an unspecified position relative to the door of the vehicle.

5. The remote access system according to claim 1, wherein the specified position is within a communication zone defined as approximately semicircular and extends from the door, with a base of the semicircular communication zone adjacent the door.

6. The remote access system according to claim 5, wherein the specified position is within a communication zone defined as approximately semicircular and extends from the handle of the door, with a base of the semicircular communication zone adjacent the handle.

7. The remote access system according to claim 5, wherein the system is configured to include a plurality of communication zones, the specified position being within at least one of the plurality of communication zones.

8. The remote access system according to claim 1, wherein the contact sensor is configured as a capacitive touch sensor on the handle of the door.

9. A vehicle, comprising:

at least one closure with a handle that includes at least one locking device configured to selectively lock and unlock the closure;

a window connected to a window actuator and configured to span a portion of the closure such that the window may be raised and lowered across the portion of the closure; and a remote access system for use with a fob configured to lock and unlock the vehicle, the remote access system including:

a position sensor configured to detect proximity between and relative position of the fob and the closure of the vehicle;

a contact sensor configured to detect contact with the handle; and a processor configured to, communicate with the position sensor and the contact sensor to lower the window a predetermined amount that facilitates opening of the door via the window actuator upon the processor determining that the fob is disposed at a specified position relative to the closure of the vehicle and that the handle has been contacted, and to extend the handle away from the door to a deployed position upon the processor determining that the fob is disposed at a specified position relative to the door closure of the vehicle.

10. The vehicle according to claim 9, wherein the processor is configured to communicate with the position sensor to pivot the handle to the retracted position in which the handle is approximately flush with adjacent portions of the door if no change in a door state is detected and one of the fob moves to an unspecified position occurs or a predetermined time period expires.

11. The vehicle according to claim 9, wherein the processor is configured to raise the window the predetermined amount via the window actuator following the lowering of the window upon the processor determining that the fob is disposed at an unspecified position relative to the door of the vehicle.

12. The vehicle according to claim 9, wherein the processor is configured to communicate with the position sensor to pivot the handle from the deployed position to the retracted position upon the processor determining that the fob is disposed at an unspecified position relative to the door of the vehicle.

13. The vehicle according to claim 9, wherein the processor is configured to lower the window upon the processor determining that the fob is within a specified range of the vehicle.

14. The remote access system according to claim 9, wherein the specified position is within a communication zone defined as substantially semicircular and extends from the door, with a base of the semicircular communication zone adjacent the door.

15. A method of operating a remote access system for a vehicle, the method comprising:

detecting, with a position sensor, a key fob at a specified position relative to a door of the vehicle;

communicating, via a processor, with the key fob;

authenticating, via the processor, a transmission of the key fob;

extending, via the processor, a door handle away from the door to a deployed position upon the processor determining that the key fob is disposed at a specified position relative to a door closure of the vehicle;

detecting, with a contact sensor, a contact with the door handle;

unlocking the vehicle door if the key fob is authenticated and contact with the door handle is detected when the door handle is in the deployed position; and actuating the window to lower a predetermined amount if the vehicle door is unlocked.

16. The method of operating a remote access system according to claim 15, wherein the actuating the window occurs upon the processor determining that the fob is within a specified range of the vehicle.

17. The method of operating a remote access system according to claim 15, further comprising:

raising the window to a closed position if no change in a door state is detected and one of the fob moves to an unspecified position occurs or a predetermined time period expires.

18. The method of operating a remote access system according to claim 15, further comprising:

defining at least one communication zone as substantially semicircular that extends from the door, the communication zone being an area within which the position sensor detects the key fob.

19. The method of operating a remote access system according to claim 18, wherein the at least one communication zone is defined as extending from the handle of the door.

* * * * *